United States Patent [19]

Mainland

[11] Patent Number: 4,866,869

[45] Date of Patent: Sep. 19, 1989

[54] SEAR FOR TRIGGER MECHANISM

[75] Inventor: Donald R. Mainland, Racine, Wis.

[73] Assignee: Remington Arms Company, Wilmington, Del.

[21] Appl. No.: 292,182

[22] Filed: Dec. 30, 1988

[51] Int. Cl.[4] ..... F41C 17/08

[52] U.S. Cl. ..... 42/70.08; 42/42.01

[58] Field of Search ..... 42/70.08, 41, 42.01

[56] References Cited

U.S. PATENT DOCUMENTS

| | | | |
|---|---|---|---|
| 2,635,380 | 4/1953 | Baker et al. | 42/70.01 |
| 2,703,943 | 5/1955 | Roemer | 42/70.01 |
| 2,794,285 | 6/1957 | Clarkson | 42/70.08 |
| 3,360,879 | 1/1968 | Freitag | 42/41 |
| 3,402,498 | 9/1968 | Freitag et al. | 42/41 |
| 3,808,724 | 5/1974 | Linde | 42/42.01 |
| 3,972,142 | 8/1976 | Kawamura | 42/69.01 |
| 4,282,795 | 8/1981 | Beretta | 89/148 |

FOREIGN PATENT DOCUMENTS

| | | | |
|---|---|---|---|
| 309090 | 1/1937 | Italy | 42/70.08 |

*Primary Examiner*—Deborah L. Kyle
*Assistant Examiner*—Michael J. Carone
*Attorney, Agent, or Firm*—D. W. Huntley

[57] ABSTRACT

Firing mechanism for a firearm which prevents discharge after jarring.

4 Claims, 3 Drawing Sheets

SEAR FOR TRIGGER MECHANISM

BACKGROUND OF THE INVENTION

A wide variety of firing mechanisms for firearms have been developed in the past. In conventional trigger mechanisms, when the gun is cocked, a sear engages a hammer. When the trigger is pulled, it causes the sear to disengage from the hammer, and the hammer falls to fire the gun.

In some previous trigger mechanisms, if a cocked gun, with the safety in the off position, is dropped or subjected to some other severe jarring force, such as the firing of the first barrel in a double-barrel shot gun, the sear can disengage from the hammer and the gun can accidentally fire. Accordingly, effort has been directed to the development of firing mechanisms in which the possibility of accidental firing, after the gun has been cocked, is reduced or eliminated.

SUMMARY OF THE INVENTION

Specifically, the instant invention provides, in a firing mechanism for a firearm comprising a quadrilateral trigger assembly, a pivotally mounted sear and a pivotally mounted hammer, the trigger assembly having a trigger component and front, rear, and top links connected to form a quadrangle, the trigger assembly positioned to engage the rear end of the sear, and the front end of the sear being spring biased downward to interlock with the hammer, which assembly, upon pulling the trigger, causes the front link to move downward, causing the rear end of the sear to pivot downward and disengage the front end of the sear from the hammer, the improvement which comprises (a) a pivotally mounted hammer catch transfer retained by abutment with a projection on the front end of the trigger assembly and in an interlocking relationship with (b) a pivotally mounted hammer catch, and (c) spring loading means to retain the hammer catch transfer in a blocking position with respect to the hammer;

and wherein the hammer catch, on operation of the trigger, is pivoted by the hammer catch transfer to a non-blocking position with respect to the hammer.

DETAILED DESCRIPTION OF THE INVENTION

In conventional gun trigger mechanisms, when the gun is cocked, a sear engages a hammer. When the trigger is pulled, it causes the sear to disengage from the hammer, and the hammer falls to fire the gun.

In some conventional trigger mechanisms, if a cocked gun, with the safety "off," is dropped or subjected to some other severe jarring force, such as the firing of the first barrel in a double-barrel shot gun, the sear can disengage from the hammer and the gun may fire.

The present invention provides an improvement in a trigger mechanism for a gun which prevents the gun from firing accidentally, as a result of being dropped or other shock, after the gun has been cocked, the safety is "off" and the gun is ready to be fired by pulling on the trigger.

Figure 1:
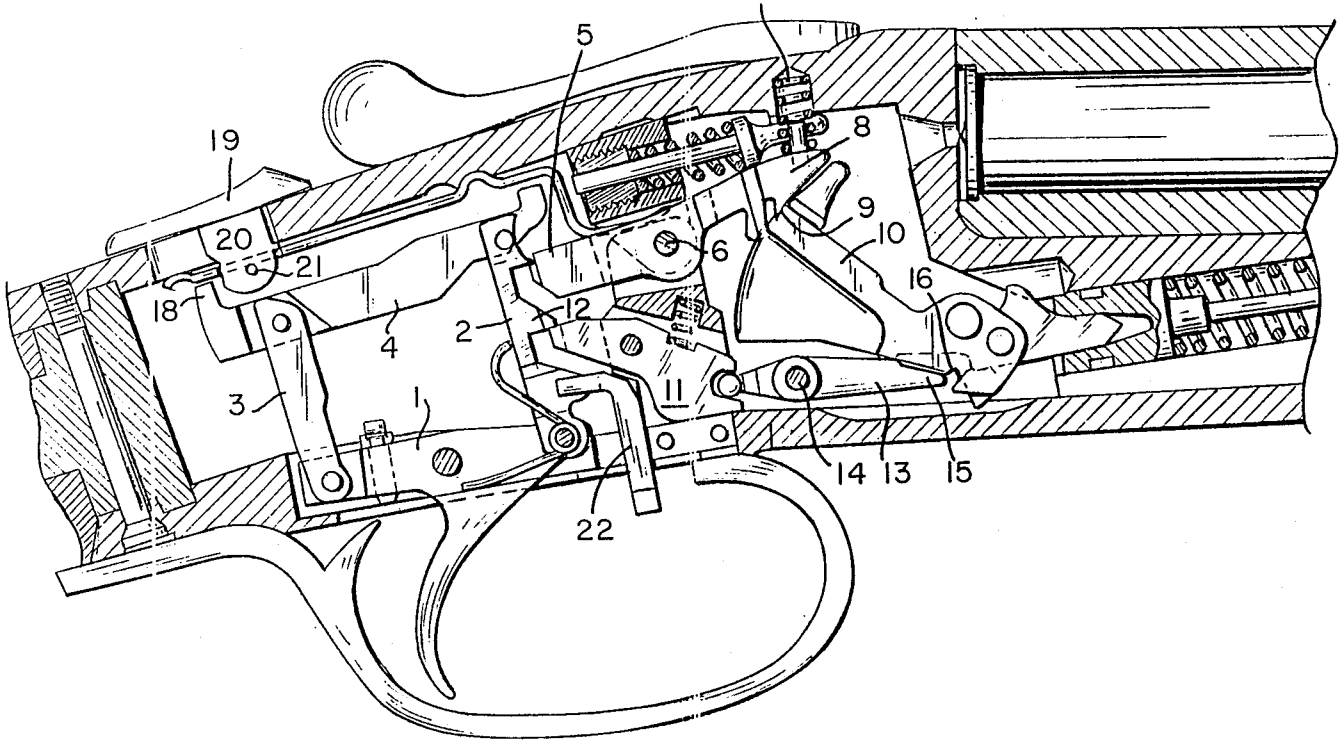
FIG. 1 is a partial side view of firearm of the present invention, cut away to show the firing mechanism cocked and ready to be fired.

FIG. 1 is a partial side view of firearm of the present invention, cut away to show the firing mechanism cocked and ready to be fired, if the trigger is pulled. The mechanism as shown is adapted to a double-barrelled shotgun. In that Figure, a quadrilateral trigger assembly is shown, comprising trigger component 1 and front, rear, and top links 2, 3 and 4, respectively, the trigger component and the front, rear, and top links connected to form a quadrangle. The trigger assembly is positioned to engage the rear end of sear 5, pivotally mounted at point 6. Sear bias spring 7 biases tang 8 on the sear into engagement with notch 9 in hammer 10. Pivotally mounted hammer catch transfer 11 is retained by abutment with the front end of the trigger assembly, in this embodiment, by a projection 12 on the front link 2 of the trigger assembly. The hammer catch transfer is in an interlocking relationship with hammer catch 13, which is pivotally mounted at point 14. The hammer catch comprises tongue 15 which is in blocking position with respect to the hammer, in that partial movement of the hammer will engage the tongue with recess 16.

Figure 2:
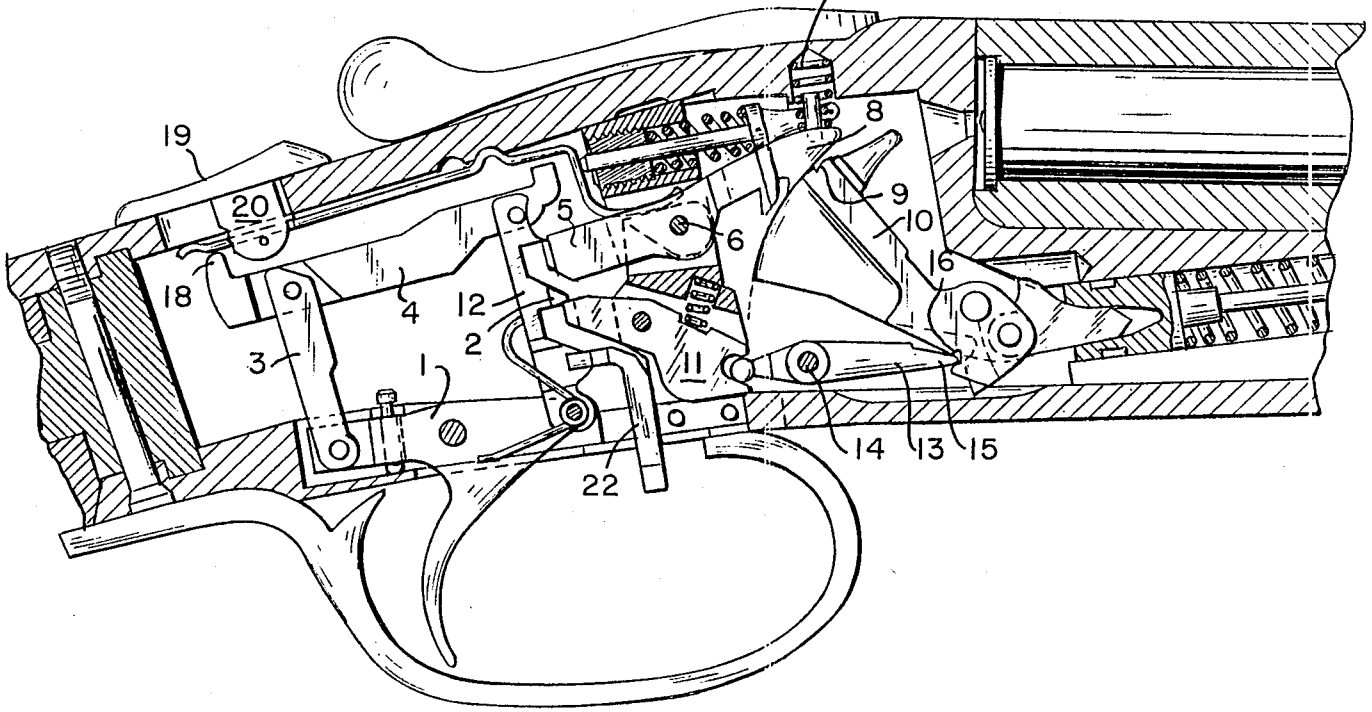
FIG. 2 is a partial side view of firearm of FIG. 1, cut away to show the firing mechanism after it has been subjected to a shock.

FIG. 2 shows the gun after it has been dropped or otherwise subjected to a shock. As a result, sear bias spring 7 has been momentarily compressed and has allowed sear 5 to pivot counterclockwise slightly. As this occurs, tang 8 disengages from notch 9 and hammer 10 pivots clockwise a short distance until tongue 15 on hammer catch 13 engages recess 16 to prevent the hammer from advancing further and accidentally firing the gun. At this point, pulling on the trigger will not cause the gun to fire and it must be recocked.

Figure 3:
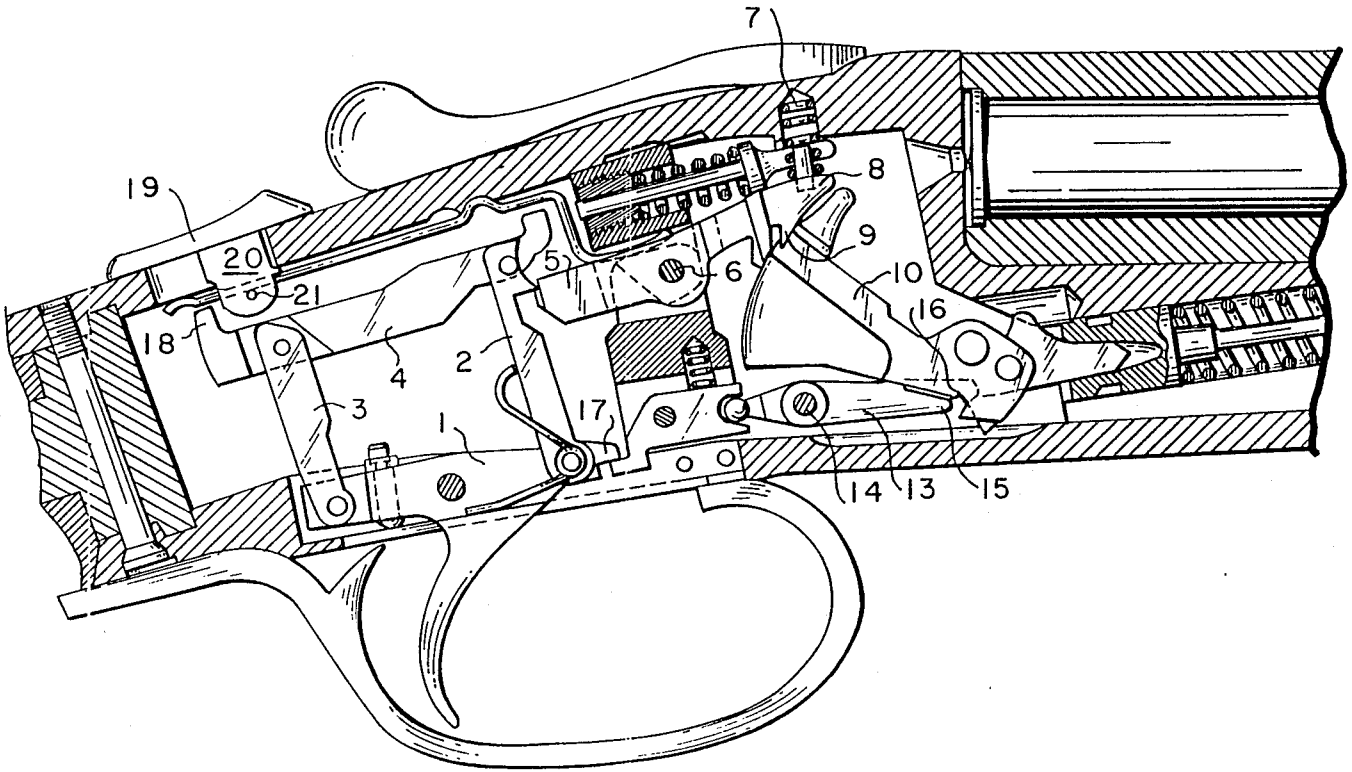
FIG. 3 is a is a partial side view of another embodiment of present invention.

FIG. 3 shows another embodiment of the present invention, in which the hammer catch transfer 11 is retained by abutment with the front end of the trigger assembly by a projection 17 which is an extension of the trigger component 1 of the trigger assembly.

The present mechanism preferably further comprises a manual safety which can engage with the rear end of the top link of the trigger assembly and, which, when activated, disengages the trigger assembly from the sear. Such a safety is shown in FIG. 1, in which top link 4 comprises projection 18 which is engaged by the safety in the "on" position and moved backward. The safety includes switch 19 which is mounted onto the spring detent 20 by a cross pin 21. The safety is shown in the "off" position, in which the trigger assembly is engaged to the sear at the projection on the front end. As the safety is slid to the rear, the trigger assembly is disengaged from the sear, and accordingly cannot remove the sear from its retaining position with respect to the hammer. The mechanism as shown also comprises selector 22 for adjusting the mechanism to operate on the right or left hand barrel of the double-barrelled gun.

The present invention represents a marked improvement in safety and reliability in a firearm, protecting against discharge from unexpected shocks even when he usual safety is in the off position.

I claim:

1. In a firing mechanism for a firearm comprising a quadrilateral trigger assembly, a pivotally mounted sear and a pivotally mounted hammer, the trigger assembly having a trigger component and front, rear, and top links connected to form a quadrangle, the trigger assembly positioned to engage the rear end of the sear, and the front end of the sear being spring biased downward to interlock with the hammer, which assembly, upon pulling the trigger, causes the front link to move downward, causing the rear end of the sear to pivot downward and disengage the front end of the sear from the hammer, the improvement which comprises (a) a pivotally mounted hammer catch transfer retained by abutment with a projection on the front end of the trigger assembly and in an interlocking relationship with (b) a pivotally mounted hammer catch, and (c) spring loading means to retain the hammer catch transfer in a blocking position with respect to the hammer;

and wherein the hammer catch, on operation of the trigger, is pivoted by the hammer catch transfer to a non-blocking position with respect to the hammer.

2. A firing assembly of claim 1 wherein the hammer catch transfer is abutted with the trigger mechanism against a projection on the front link of the trigger assembly.

3. A firing assembly of claim 1 wherein the hammer catch transfer is abutted with the trigger mechanism against a projection on the trigger component of the trigger assembly.

4. A firing mechanism of claim 1 further comprising a safety mechanism which is engaged to the rear end of the top link of the trigger assembly and, which, when activated, disengages the trigger assembly from the sear.

* * * * *